US005592184A

United States Patent [19]

Cassel et al.

[11] Patent Number: 5,592,184

[45] Date of Patent: Jan. 7, 1997

[54] MINIATURE ANTENNA

[75] Inventors: Erland Cassel; Jan Cassel, both of Djursholm, Sweden

[73] Assignee: Telefonaktiebolaget LM Ericsson, Stockholm, Sweden

[21] Appl. No.: 447,344

[22] Filed: May 23, 1995

Related U.S. Application Data

[63] Continuation of Ser. No. 203,733, Feb. 28, 1994, abandoned, and Ser. No. 929,447, Aug. 14, 1992, abandoned.

[30] Foreign Application Priority Data

Aug. 16, 1991 [SE] Sweden ..... 9102379

[51] Int. Cl.[6] ..... H01Q 1/36; H01Q 9/40

[52] U.S. Cl. ..... 343/752; 343/702; 343/895

[58] Field of Search ..... 343/895, 749, 343/752, 702, 860, 873; H01Q 1/36, 11/08

[56] References Cited

U.S. PATENT DOCUMENTS

| | | | |
|---|---|---|---|
| 2,993,204 | 7/1961 | Macalpine | 343/752 |
| 3,573,840 | 4/1971 | Gouillou et al. | 343/895 |
| 4,012,744 | 3/1977 | Greiser | 343/895 |
| 4,137,534 | 1/1979 | Goodnight | 343/895 |
| 4,161,737 | 7/1979 | Albright | 343/895 |
| 4,742,359 | 5/1988 | Ishino et al. | 343/895 |
| 5,216,436 | 6/1993 | Hall et al. | 343/752 |

FOREIGN PATENT DOCUMENTS

| | | | |
|---|---|---|---|
| 2175748 | 12/1986 | United Kingdom | H01Q 1/36 |

*Primary Examiner*—Michael C. Wimer

*Attorney, Agent, or Firm*—Burns, Doane, Swecker & Mathis, L.L.P.

[57] ABSTRACT

A miniature antenna with an elongated base portion and an essentially circular top loop that is perpendicular thereto. A U-shaped load is connected between the partially helical base portion and the top loop, and its first leg is connected essentially perpendicular to the elongated base portion while its second leg is connected essentially tangential to the top loop.

11 Claims, 3 Drawing Sheets

MINIATURE ANTENNA

This application is a continuation of application Ser. No. 07/929,447, filed Aug. 14, 1992, now abandoned, and a continuation of application Ser. No. 08/203,733, filed Feb. 28, 1994 abandoned.

TECHNICAL FIELD

The present invention relates to a miniature antenna, preferably for pocket telephones, comprising a base portion with a longitudinal axis and an essentially circular top loop that is essentially perpendicular to said axis.

BACKGROUND OF THE INVENTION

Antennas for pocket telephones are usually comprised of an antenna rod with a length of a half or a quarter of a wavelength.

The half wave antenna has a current distribution in the form of half of a sine wave, that is the current is zero at the ends and has a maximum in the middle. This antenna type works well from a technical point of view, but it has the drawback that it is bulky. This is because at the usually used radio frequencies of 900 MHz a wavelength of approximately 30 cm is obtained. This means an antenna length of approximately 15 cm, which by many users is considered unpractical and implies a risk that the antenna will be damaged when the pocket telephone is used.

A quarter wave antenna is half as long, that is 7–8 cm, and is therefore more practical. However, this antenna type has an unfavourable current distribution in the form of a quarter of a sine wave, the current being zero at the top of the antenna and at a maximum at the antenna base.

Furthermore, a circularly polarized antenna comprising an elongated base portion and an essentially circular top loop that is perpendicular thereto is known per se from "Antennas", John D. Kraus, McGraw-Hill.

An object of the present invention is to provide a linearly polarized miniature antenna that in addition to being short also provides an essentially rectangular current distribution between the point of connection at the antenna base and the antenna top.

SUMMARY OF THE INVENTION

In accordance with the present invention the above object is solved by a miniature antenna of the type mentioned in the introductory part, in which said base portion partially comprises a helix wound around said axis and is provided with means for reflection-free adaption to said top loop.

BRIEF DESCRIPTION OF THE DRAWINGS

The invention, together with further objects and advantages thereof, may best be understood by making reference to the following description taken together with the accompanying.

DETAILED DESCRIPTION OF THE PREFERRED EMBODIMENTS

Figure 1:
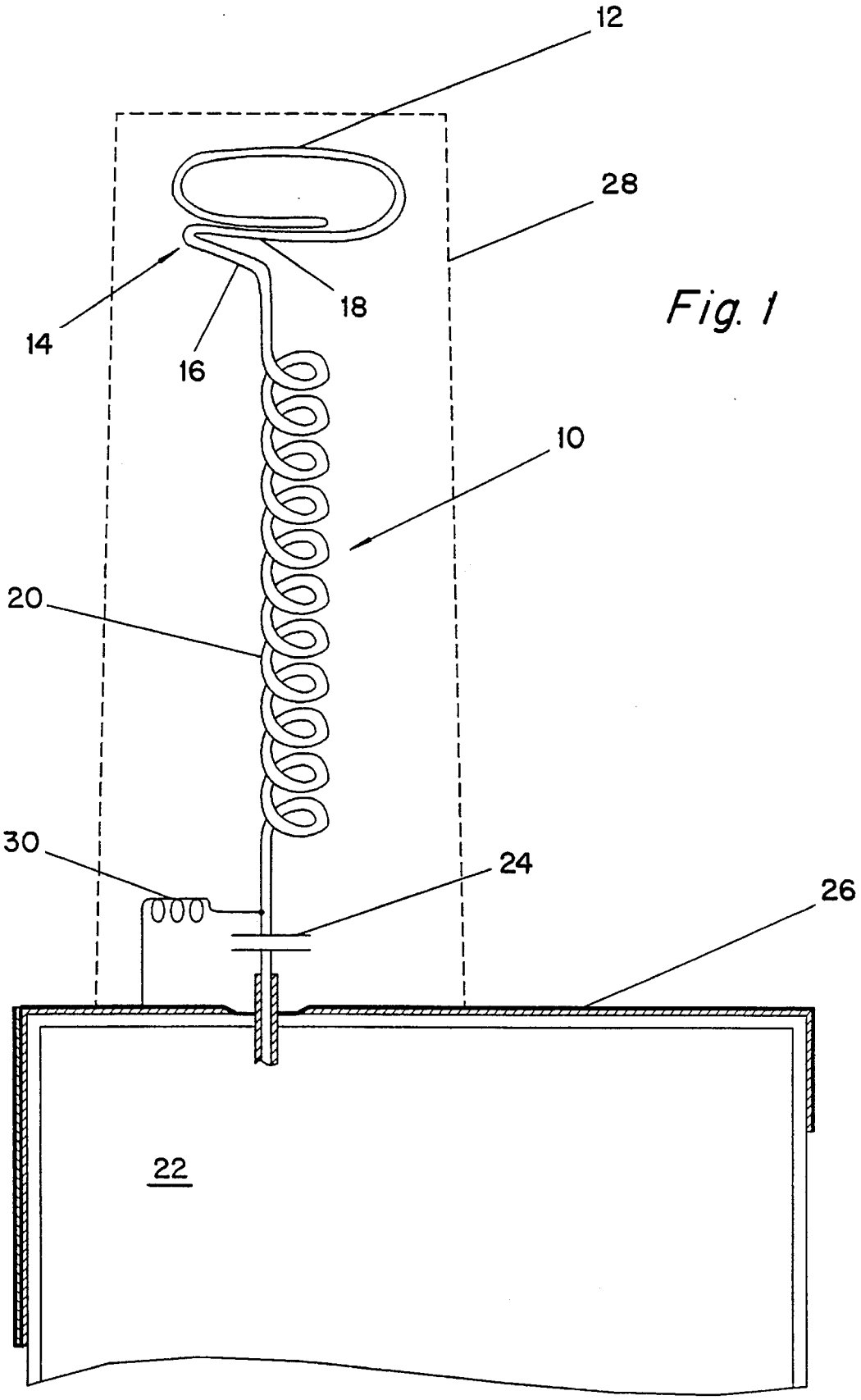
FIG. 1 illustrates a preferred embodiment of a miniature antenna in accordance with the present invention.
Figure 3:
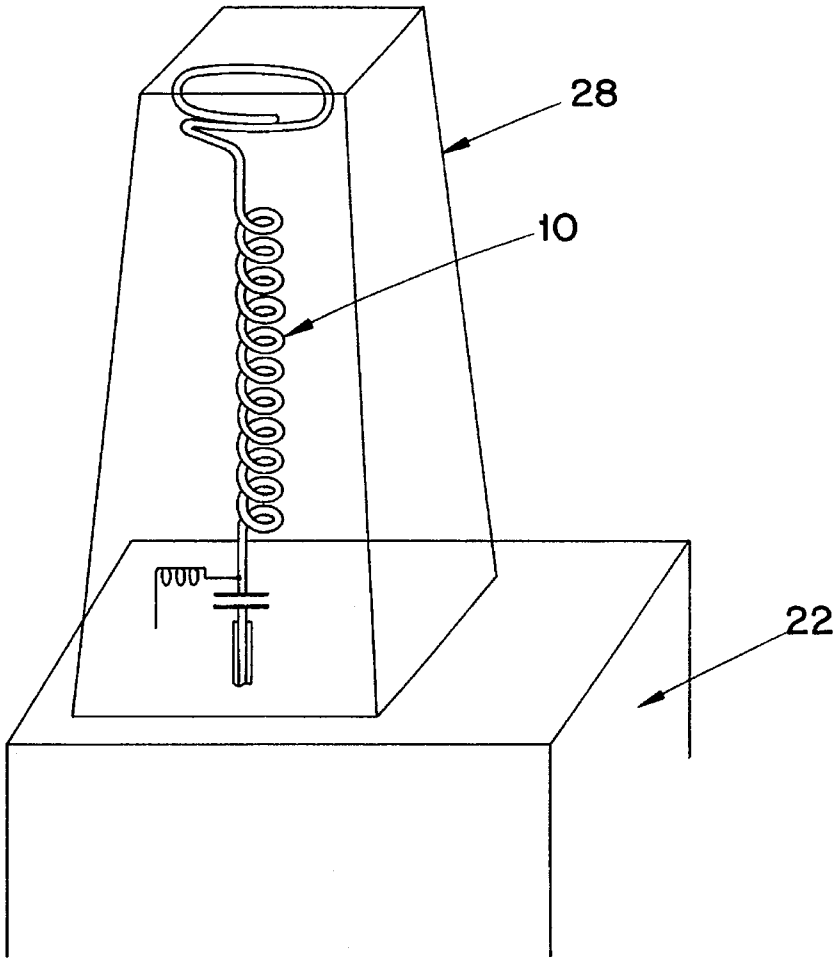
FIG. 3 illustrates a miniature antenna surrounded by a dielectric material according to one embodiment of the present invention.
Figure 2:
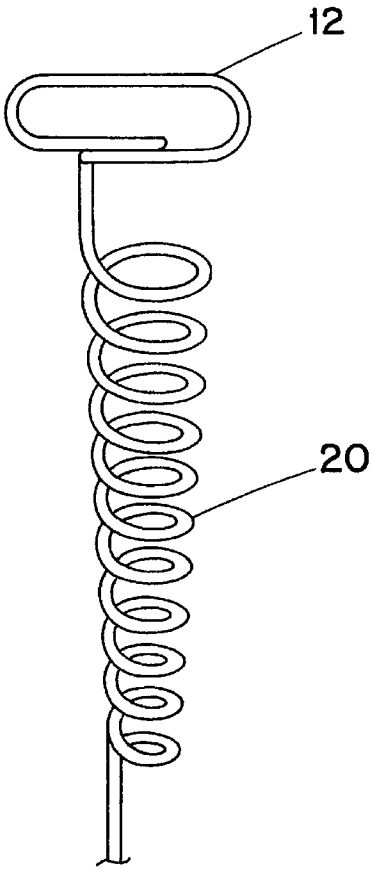
FIG. 2 illustrates another embodiment of a miniature antenna in accordance with the present invention.
Figure 4:
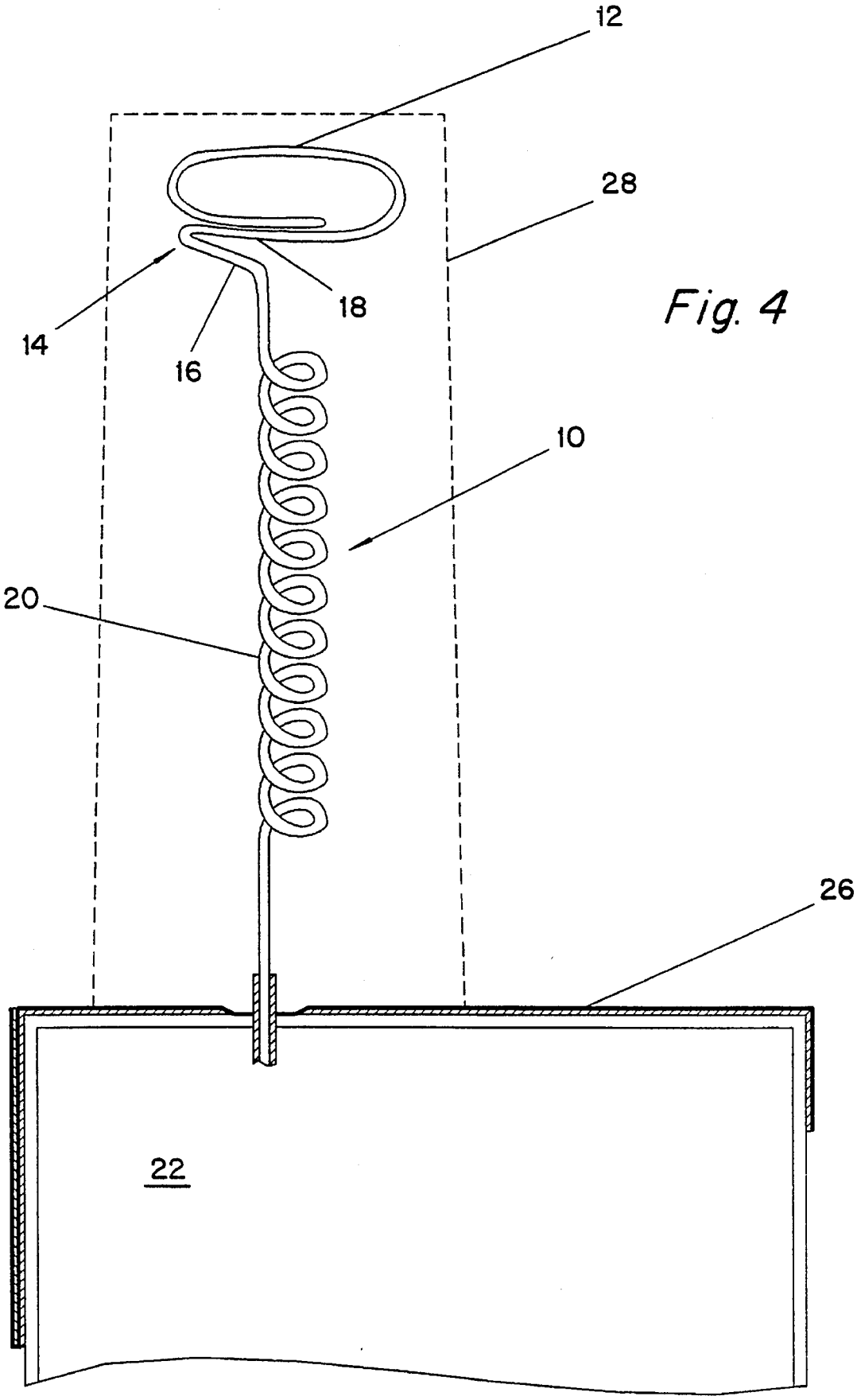
FIG. 4 illustrates a direct connection arrangement according to one embodiment of the present invention.

The miniature antenna in accordance with the present invention comprises a base portion 10 and an essentially circular top loop 12, that is essentially perpendicular to the base portion 10. The top loop 12 comprises at least one, preferably a bit more than one, turn, wherein an end of the circular loop is not physically connected to the circular loop as illustrated in FIG. 1.

A U-shaped load 14 is provided between base portion 10 and top loop 12. The first leg 16 of the load 14 is connected essentially perpendicular to base portion 10, while its second leg 18 is connected essentially tangential to top loop 12. The U-shaped load 14 increases the current flow to top loop 12. This gives a desired rectangular current distribution.

In the preferred embodiment of the invention shown in the drawing the plane in which the U-shaped load 14 lies is perpendicular to top loop 12. However, it is also possible to provide the U-shaped load 14 in a plane that is perpendicular to base portion 10.

The base portion 10 has a helically wound mid portion 20 comprising for instance, about 10 turns. In the drawing, the helix has a uniform diameter.

In an alternate embodiment, the diameter of the helix increases towards the top loop 12. Near the top loop, the diameter of the helix preferably is smaller than the diameter of the top loop. As an example, the helix can comprise 5 turns with an average diameter increasing from 5 mm in the first turn to 6.5 mm in the fifth turn and a pitch of about 3 mm, while the top loop has an average diameter of 9 mm. In this embodiment, the U-shaped load 14 can be eliminated since the increasing diameter of the helix will perform the reflection-free adaption of base portion 10 to top loop 12.

In a preferred embodiment the whole antenna is formed by a single thread, which from the base portion 10 extends into the U-shaped load 14 and thereafter into the top loop 12 wherein the antenna has a length of approximately 30 mm or alternatively on the order to 1/10 of a wavelength suitable for cellular communications.

The miniature antenna is suitably connected to a schematically shown transmitter/receiver 22, either directly or over a matching circuit comprising, for instance, a series capacitor 24 and a parallel inductor 30.

Furthermore, a U-shaped metal band 26, forming an antenna aperture enlarging and chassis isolating metal grounding plane, can be provided between the capacitor 24 and the transmitter/receiver 22 at the current feeding point of the antenna. Such a band is especially suitable when the apparatus case has a metal frame. The purpose of the grounding plane is to decouple the antenna from the metal frame and to increase the antenna aperture. This is especially important for short antennas. By letting a resonant band shaped metal grounding plane with a total electrical length of a half wavelength follow the frame structure at a distance of one or a few millimeters and by letting this band have the same or a few millimeters larger width than the frame and by connecting the band to the frame only at the antenna connection point, it is possible to avoid current induction in the frame. In order to shorten the band, it can be folded to form one or several pockets as is shown in the left part of the drawing. Such a pocket has the function of a shortening series inductor. Since the band does not lie directly on the frame, except at the current feeding point, similar pockets are formed which are also between the frame and the ends of the band. These pockets should have an electrical length that corresponds to a quarter of a wavelength, referred to the mid frequency of the working range of the antenna, i.e., they should have a high input impedance to prevent current from being transferred to the frame. When the band is shortened, this becomes possible only by electrically extending the pocket by filling it with a dielectric that compensates for the shortening.

If the antenna is arranged non-symmetrically as shown in the drawing the antenna radiation is reduced in the direction towards the closest corner of the apparatus frame. In this case, the band can be extended more along the closest frame side to compensate for the radiation reduction.

In a preferred embodiment of the miniature antenna in accordance with the present invention, the antenna is embedded in a dielectric material, preferably with a dielectric constant of approximately 3, for instance silicone. The dielectric material can, for instance, be in the shape of a frustum of a cone 28, the thicker part of which surrounds the elongated base portion 10 and the thinner part of which surrounds the U-shaped load 14 and the top loop 12. By this embedding in a dielectric material, the antenna can be further shortened and further more be better protected against punches.

At a carrier frequency of approximately 895 MHz, the antenna, when combined with an ordinary sized pocket phone, preferably has the following data:

| | |
|---|---|
| Antenna length | 31.5 mm |
| Thread length (including inductor 30) | 130 mm |
| Thread diameter | 0.75 mm |
| Number of turns in base portion | 11 |
| Outer diameter | 3.5 mm |
| Length of wound portion | 15.5 mm |
| Number of turns in top loop | 1.5 |
| Outer diameter | 8.5 mm |
| Length of leg of U-shaped load | 7 mm |
| Height of load + top loop | 3 mm |
| Length between load and wound portion | 3 mm |
| Length between wound portion and pocket phone | 10 mm |
| Thread material | silver plated copper |
| Dielectric material in cone | Sylgard 170 from DOW CORNING CORP, USA |
| Cone diameter at top | 12 mm |
| Cone diameter at base | 13 mm |
| Capacitor | 47 pf, ceramic |
| Inductor | 9 turns, outer diameter 2.5 mm, thread diameter 0.75 mm |

It will be understood by those skilled in the art that various modifications and changes may be made to the present invention without departure from the spirit and scope thereof, which is defined by the appended claims. For instance the dimensions of the antenna can be changed to make it suitable for other frequencies, for instance frequencies around 450 MHz or 1700 MHz.

We claim:

1. A linearly polarized miniature antenna, comprising:

a substantially helical base portion wound around a longitudinal axis and having a length of less than a quarter of a wavelength suitable for cellular communications;

a substantially circular top loop arranged perpendicular to said axis and having a larger diameter than said helical base portion; and a substantially U-shaped load connecting said helical base portion to said circular top loop for creating a rectangular current distribution in said antenna, said U-shaped load comprising:

a first elongated leg substantially perpendicular to said axis, a second elongated leg substantially perpendicular to said axis, and a bend of approximately 180 degrees connecting said first leg to said second leg so that said legs are substantially parallel to each other.

2. The antenna according to claim 1, wherein said top loop comprises at least a full turn.

3. The antenna according to claim 1, wherein said helical base portion comprises approximately 10 turns.

4. The antenna according to claim 1, wherein the antenna is embedded in a dielectric material.

5. The antenna according to claim 4, wherein the dielectric material has a dielectric constant of approximately 3.

6. The antenna according to claim 5, wherein the dielectric material has the form of a frustum of a cone having a base section and an apex, wherein said base section of said dielectric material surrounds said base portion of said antenna and said apex surrounds said top loop.

7. The antenna according to claim 6, wherein the antenna has a length on an order of 1/10 of a wavelength suitable for cellular communications.

8. The antenna according to claim 7, wherein the antenna has a length of approximately 30 mm.

9. The antenna according to claim 1, wherein said base portion is connected to a matching circuit which is connected to a transmitter/receiver.

10. The antenna according to claim 2, wherein said top loop comprises approximately 1.5 turns.

11. The antenna according to claim 7, wherein the antenna has a length of approximately 31.5 mm for the frequency range of 825–895 MHz.

* * * * *